US010974315B2

(12) United States Patent
Kitahara et al.

(10) Patent No.: US 10,974,315 B2
(45) Date of Patent: Apr. 13, 2021

(54) PRODUCTION METHOD AND PRODUCTION APPARATUS OF CONTINUOUSLY CAST METAL ROD

(71) Applicant: SHOWA DENKO K.K., Tokyo (JP)

(72) Inventors: Masanori Kitahara, Fukushima (JP); Saeha Yamane, Kanagawa (JP)

(73) Assignee: SHOWA DENKO K.K., Tokyo (JP)

( * ) Notice: Subject to any disclaimer, the term of this patent is extended or adjusted under 35 U.S.C. 154(b) by 0 days.

(21) Appl. No.: 16/804,485

(22) Filed: Feb. 28, 2020

(65) Prior Publication Data

US 2020/0276635 A1 Sep. 3, 2020

(30) Foreign Application Priority Data

Feb. 28, 2019 (JP) ..... JP2019-036612

(51) Int. Cl.

| | |
|---|---|
| ***B22D 11/04*** | (2006.01) |
| ***B22D 11/049*** | (2006.01) |
| ***B22D 11/124*** | (2006.01) |
| ***B22D 11/22*** | (2006.01) |
| ***B22D 11/055*** | (2006.01) |

(52) U.S. Cl.

CPC ..... *B22D 11/055* (2013.01); *B22D 11/0403* (2013.01); *B22D 11/049* (2013.01); *B22D 11/1246* (2013.01); *B22D 11/22* (2013.01)

(58) Field of Classification Search

CPC ... B22D 11/049; B22D 11/1246; B22D 11/22; B22D 11/225

See application file for complete search history.

(56) References Cited

U.S. PATENT DOCUMENTS 4,597,432 A * 7/1986 Collins ..... B22D 11/049 164/348

FOREIGN PATENT DOCUMENTS

| | | | |
|---|---|---|---|
| JP | 2003-211255 A | 7/2003 | |
| JP | 2006-51535 A | 2/2006 | |
| WO | WO-8800867 A1 * | 2/1988 | ..... B22D 11/0403 |

OTHER PUBLICATIONS

English Abstract of JP 2003-211255 A published Jul. 29, 2003.
English Abstract of JP 2006-051535 A published Feb. 23, 2006.

* cited by examiner

*Primary Examiner* — Kevin E Yoon
(74) *Attorney, Agent, or Firm* — Millen, White, Zelano & Branigan, P.C.; William Nixon

(57) ABSTRACT

Provided is a production method capable of producing a high-quality continuously cast material. A cooling liquid is supplied to each of outer peripheral surfaces of a plurality of ingots extracted in parallel from a plurality of molds to cool the plurality of ingots. Of the outer peripheral surfaces of the ingot, a region which is open and does not face another ingot is defined as an open region, and a region which faces another ingot is defined as an ingot facing region. The open region is cooled with weak cooling in which the degree of cooling by the cooling liquid in the open region is set to be less than the degree of cooling by the cooling liquid in the ingot facing region.

3 Claims, 8 Drawing Sheets

PRODUCTION METHOD AND PRODUCTION APPARATUS OF CONTINUOUSLY CAST METAL ROD

TECHNICAL FIELD

The present disclosure relates to a production method and a production apparatus for a continuously cast metal rod for producing a continuously cast material made of metal such as aluminum.

Note that in this specification and claims, unless otherwise specified, the term "aluminum (Al)" is used to include the meaning of an aluminum alloy (Al alloy), and the terms "continuous casting" and "continuously cast" are used to include the meaning of "semi-continuous casting" and "semi-continuously cast", respectively.

TECHNICAL BACKGROUND

In various aluminum products based on aluminum materials, a forged product produced by forging, a rolled product produced by rolling, and an extruded product produced by extrusion are often used for products requiring high quality and high strength with less variation. A forging material, a rolling material, and an extrusion material to be subjected to the above processing are often produced based on a continuously cast material obtained by continuously casting aluminum.

For example, as a production apparatus (continuous casting apparatus) for producing a continuously cast material, as described in Patent Documents 1 and 2 listed below, a vertical-type continuous casting apparatus in which the casting direction is vertically downward is known. In this vertical-type continuous casting apparatus, a molten metal is passed through a mold, and a surface of an ingot is solidified, and cooling water as a cooling liquid (cooling medium) is ejected to the ingot from the entire periphery of the ingot right under the mold to rapidly cool down the entire ingot.

As a conventional cooling water ejection method for cooling an ingot, as shown in Documents 1 and 2, a method of ejecting cooling water from slit-like or circular hole-like cooling water spouting ports provided around the outer periphery of an ingot is generally used.

In such aluminum continuous casting, the step of cooling an ingot is a very important step, and by being rapidly solidified from the entire periphery of the ingot to the inside thereof (central portion) in a balanced manner, the ingot structure can be controlled in a good state, so that the material crystal structure, the crystalline, and the precipitation behavior become uniform in the entirety of the ingot. Thus, a high quality continuously cast material having a good ingot structure with no variation can be produced.

PRIOR ART DOCUMENT

Patent Document

Patent Document 1: Japanese Unexamined Patent Application Publication No. 2006-51535

Patent Document 2: Japanese Unexamined Patent Application Publication No. 2003-211255

SUMMARY OF THE INVENTION

Problems to be Solved by the Invention

In a conventional continuous aluminum casting method, in order to improve productivity, etc., a so-called multiple continuous casting has been often used in which a number of molds are arranged in parallel and a number of continuously cast rods are continuously cast simultaneously in parallel when a molten metal passes through each mold. In such a multiple continuous casting, since the outer peripheral surface of the continuously cast rod has a complex temperature distribution due to thermal influences between adjacent continuously cast rods, not all continuously cast materials could be cooled in a balanced manner. Therefore, there was a problem that it was difficult to assuredly produce a high quality continuously cast material.

The preferred embodiments of the present invention have been made in view of the abovementioned and/or other problems in the related art. The preferred embodiments of the present invention can significantly improve upon existing methods and/or apparatuses.

The present invention has been made in view of the aforementioned problems and aims to provide a production method and a production apparatus of a continuously cast metal rod capable of cooling all of ingots in a balanced manner and producing a high quality continuously cast material.

The other purposes and advantages of the present invention will be apparent from the following preferred embodiments.

Means for Solving the Problem

In order to solve the aforementioned problems, the present invention is provided with the following means.

[1] A method of producing a continuously cast metal rod in which a cooling liquid is supplied to each of outer peripheral surfaces of a plurality of ingots extracted from a plurality of molds in parallel to cool each of the plurality of ingots, wherein when a region of an outer peripheral surface of the ingot which is open and does not face another ingot is defined as an open region, and a region of the outer peripheral surface of the ingot which faces another ingot is defined as an ingot facing region, the open region is cooled with weak cooling in which a degree of cooling by the cooling liquid at the open region is less than a degree of cooling by the cooling liquid at the ingot facing region.

[2] The method of producing a continuously cast metal rod as recited in the aforementioned Item [1], wherein a supply quantity of the cooling liquid to the open region is set to be less than a supply quantity of the cooling liquid to the ingot facing region.

[3] The method of producing a continuously cast metal rod as recited in the aforementioned Item [1] or [2], wherein supply pressure of the cooling liquid to the open region is set to be lower than supply pressure of the cooling liquid to the ingot facing region.

[4] An apparatus of producing a continuously cast metal rod, comprising:

a plurality of molds arranged in parallel; and a plurality of cooling liquid spouting ports provided corresponding to each mold, wherein a cooling liquid is supplied from the plurality of cooling liquid spouting ports to each of outer peripheral surfaces of a plurality of ingots extracted in parallel from the plurality of molds to cool the plurality of ingots, respectively, wherein when a region of an outer peripheral surface of the ingot which is open and does not face another ingot is defined as an open region, and a region of the outer peripheral surface of the ingot which faces another ingot is defined as an ingot facing region, a supply quantity adjustment means configured to adjust such that a supply quantity of the cooling liquid to the open region is less than a supply quantity of the cooling liquid to the ingot facing region is provided.

[5] The apparatus of producing a continuously cast metal rod as recited in the aforementioned Item [4], wherein the plurality of cooling liquid spouting ports is arranged at intervals along an outer periphery of a corresponding ingot and is configured such that the cooling liquid is spouted from respective cooling liquid spouting ports to be supplied to the outer peripheral surface of a corresponding ingot, wherein a total opening area of the cooling liquid spouting ports arranged corresponding to the open region of the ingot among the plurality of cooling liquid spouting ports is set to be smaller than a total opening area of the cooling liquid spouting ports arranged corresponding to the ingot facing region among the plurality of cooling liquid spouting ports, and wherein the plurality of cooling liquid spouting ports serves as the supply quantity adjustment means.

[6] The apparatus of producing a continuously cast metal rod as recited in the aforementioned Item [5], wherein a caliber of the cooling liquid spouting port arranged corresponding to the open region of the ingot among the plurality of cooling liquid spouting ports is set to be smaller than a caliber of the cooling liquid spouting port arranged corresponding to the ingot facing region.

[7] The apparatus of producing a continuously cast metal rod as recited in the aforementioned Item [5] or [6], wherein an interval of the plurality of cooling liquid spouting ports arranged corresponding to the open region of the ingot among the plurality of cooling liquid spouting ports is set to be wider than an interval of a plurality of cooling liquid spouting ports arranged corresponding to the ingot facing region among the plurality of cooling liquid spouting ports.

[8] The apparatus of producing a continuously cast metal rod as recited in any one of the aforementioned Items [4] to [7], further comprising:

supply pressure adjustment means configured to adjust such that supply pressure of the cooling liquid to the open region is set to be lower than supply pressure of the cooling liquid to the ingot facing region, wherein the supply pressure adjustment means serves as the supply quantity adjustment means.

Effects of the Invention

According to the method of producing a continuously cast rod according to the aforementioned Item [1], since the open region of the outer peripheral surface of the ingot which does not face another ingot is cooled with weak cooling compared with the ingot facing region which faces another ingot, the open region which receives a small heat effect from another ingot and can be effectively cooled can be cooled with weak cooling, and the ingot facing region which receives a large heat effect from another ingot and cannot be effectively cooled can be cooled with strong cooling. Therefore, each ingot can be cooled in a well-balanced manner from the entire periphery to the center portion, so that the entirety of the ingot can be formed to have an even and excellent ingot structure. Thus, it is possible to assuredly cast a continuously cast material as a high-quality ingot with no variation.

According to the method of producing a continuously cast metal rod as recited in the aforementioned Items [2] and [3], the above-mentioned effects can be obtained more assuredly.

According to the apparatus of producing a continuously cast metal rod as recited in the aforementioned Item [4], since it is equipped with a supply quantity adjustment means to adjust such that the supply quantity of the cooling liquid to an open region of the outer peripheral surface of the ingot which does not face another ingot is less than the supply quantity of the cooling liquid to the ingot facing region which faces another ingot, the open region can be cooled with weak cooling compared with the ingot facing region. Therefore, similarly to the above, each ingot can be cooled in a balanced manner from the entire circumference to the center portion, so that the entire ingot can be formed to have an even and excellent ingot structure. Therefore, a cast material as a high-quality ingot with no variation can be assuredly produced.

According to the apparatus of producing a continuously cast metal rod as recited in any one of the aforementioned Items [5] to [8], it is possible to obtain the above-mentioned effects more assuredly.

EMBODIMENTS FOR CARRYING OUT THE INVENTION

Figure 1:
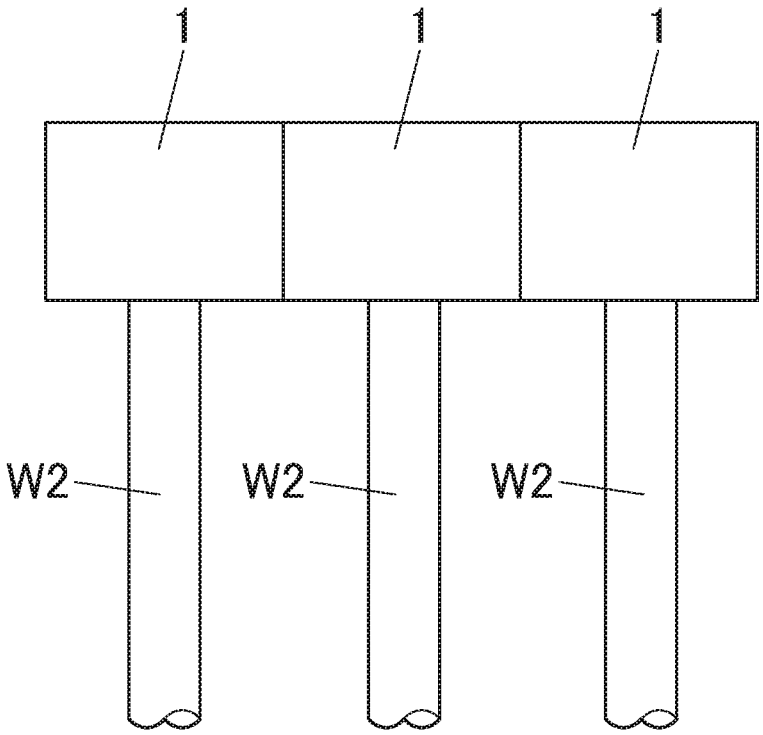
FIG. 1 is a side view schematically showing a vertical-type continuous casting apparatus as a production apparatus of a continuously cast rod according to an embodiment of the present invention.
Figure 2:
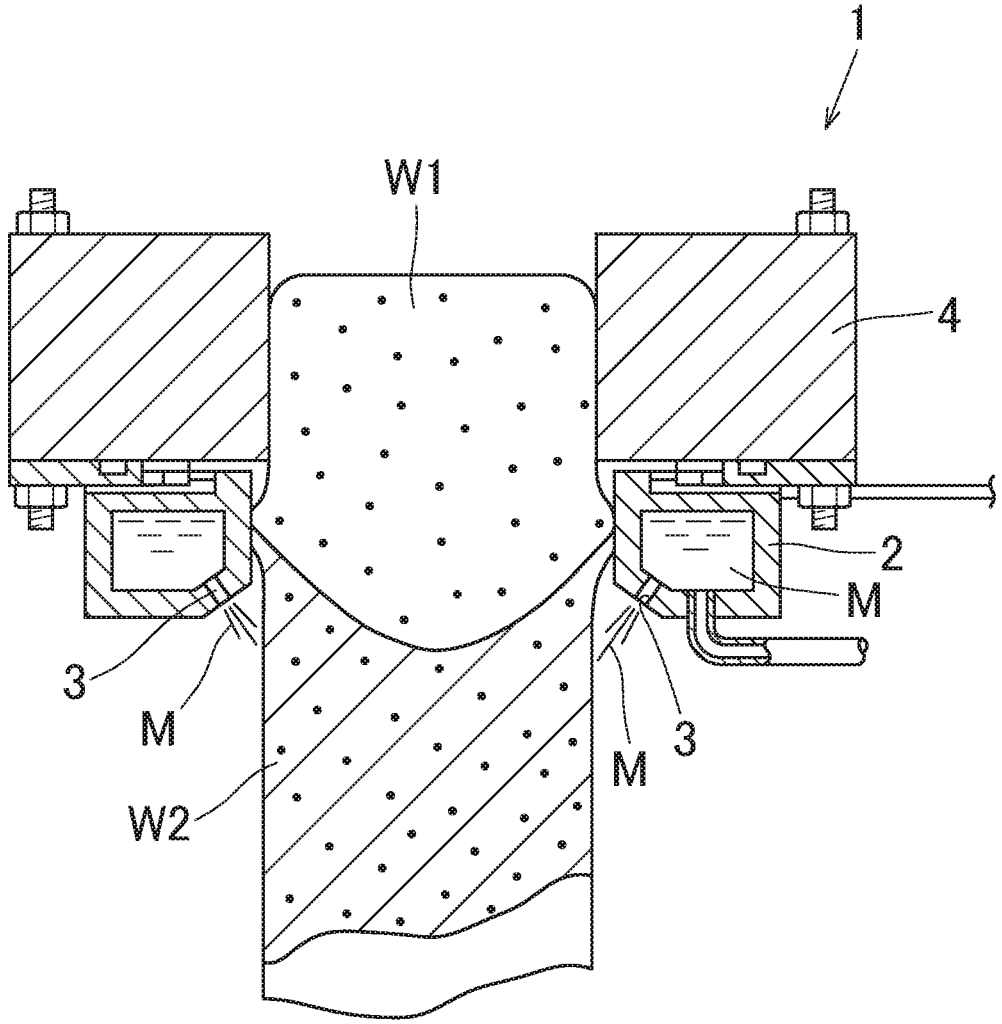
FIG. 2 is a side cross-sectional diagram showing a hot-top casting apparatus applied to the continuous casting apparatus according to an embodiment.

FIG. 1 is a side view schematically showing a vertical-type continuous casting apparatus to which a continuous casting apparatus is applied as a production apparatus of a continuously cast aluminum material according to an embodiment of the present invention. FIG. 2 is a side cross-sectional diagram showing a hot-top casting machine 1 applied to a casting apparatus according to the embodiment.

As shown in FIG. 1, the casting apparatus is provided with three hot-top casting machines 1 arranged in parallel. As shown in FIG. 1 and FIG. 2, each casting machine 1 is provided with a mold 2 for casting an ingot W2 by solidifying an aluminum molten metal W1, spouting ports 3 as cooling liquid spouting ports provided at the lower end portion of each mold 1, and a molten metal receiving tank 4 provided on the upper side of the mold 1 and configured to supply a molten metal W1 into the mold 2.

Figure 5A:
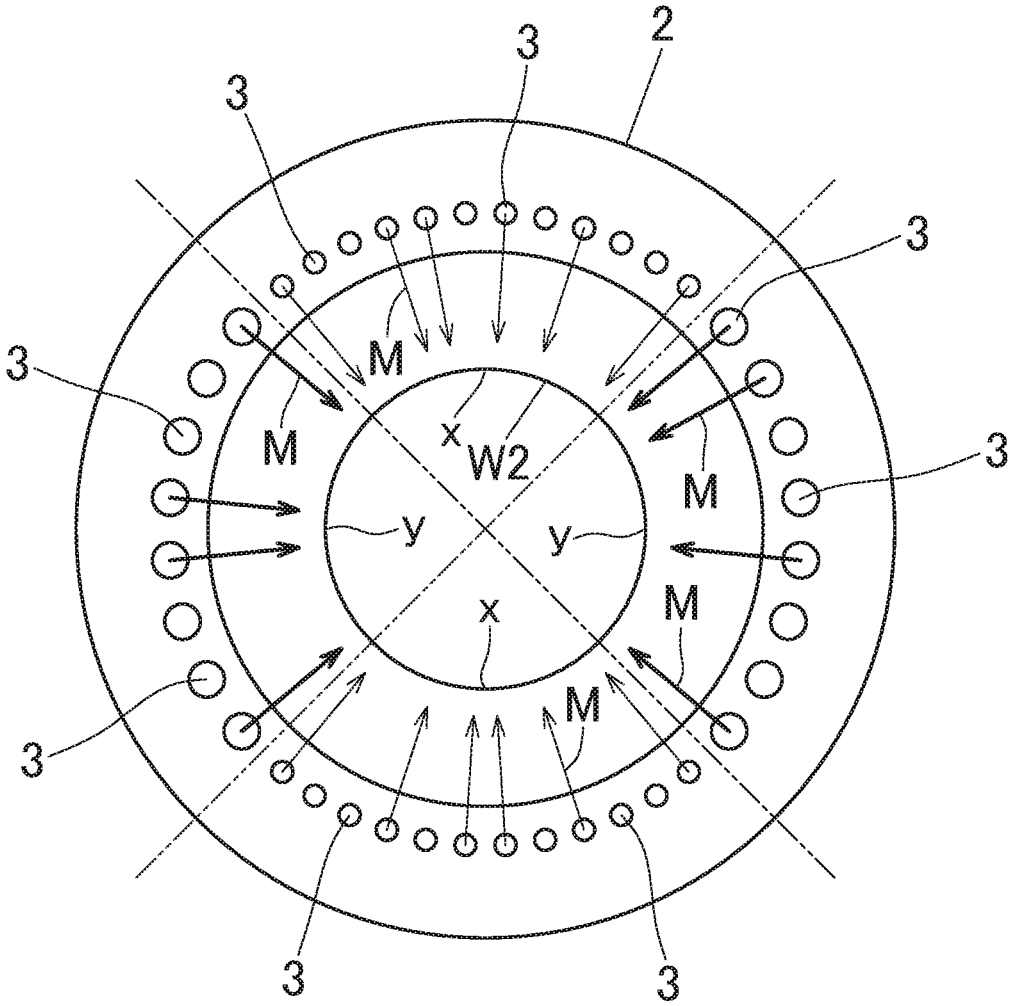
FIG. 5A is a horizontal cross-sectional view schematically showing a first example of a hot-top casting apparatus according to an embodiment.
Figure 5B:
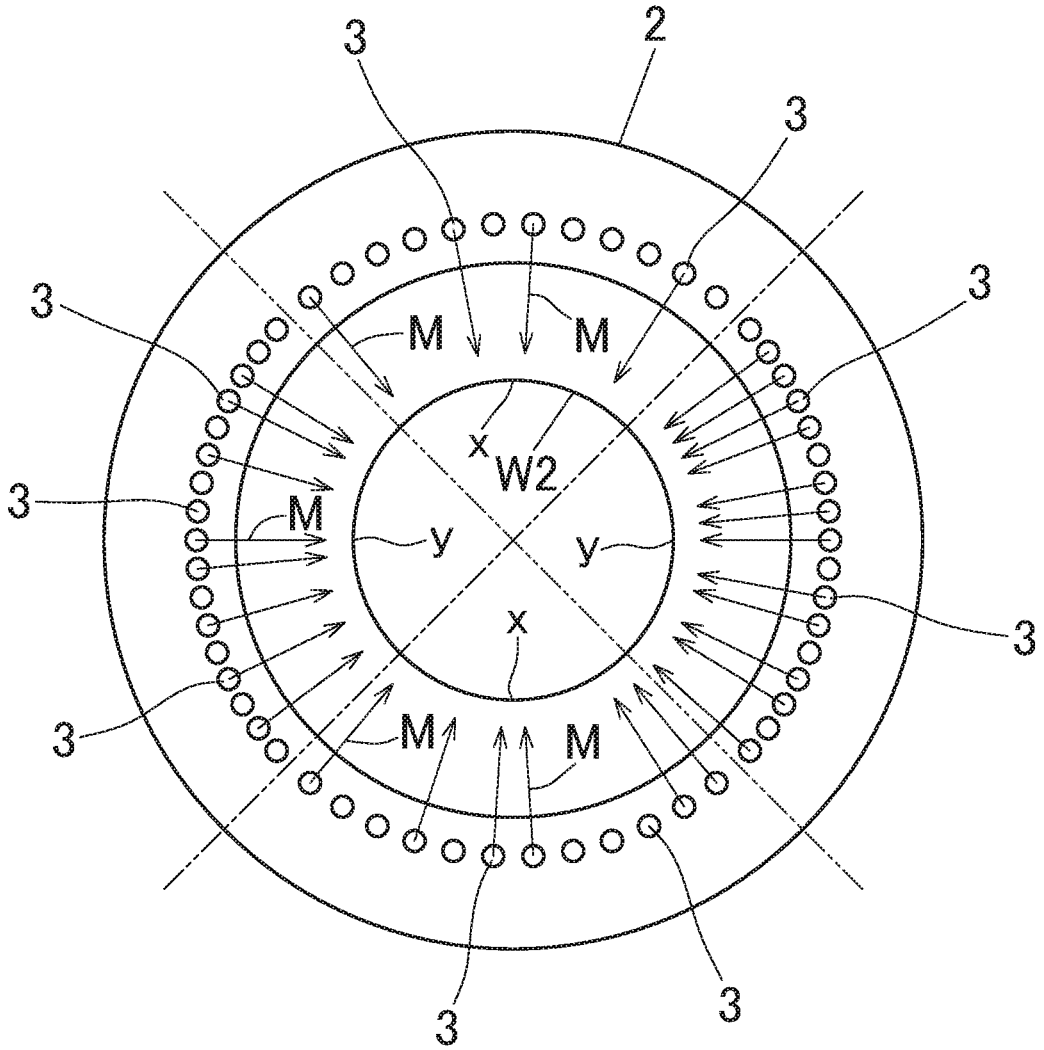
FIG. 5B is a horizontal cross-sectional view schematically showing a second example of a hot-top casting apparatus according to an embodiment.
Figure 5C:
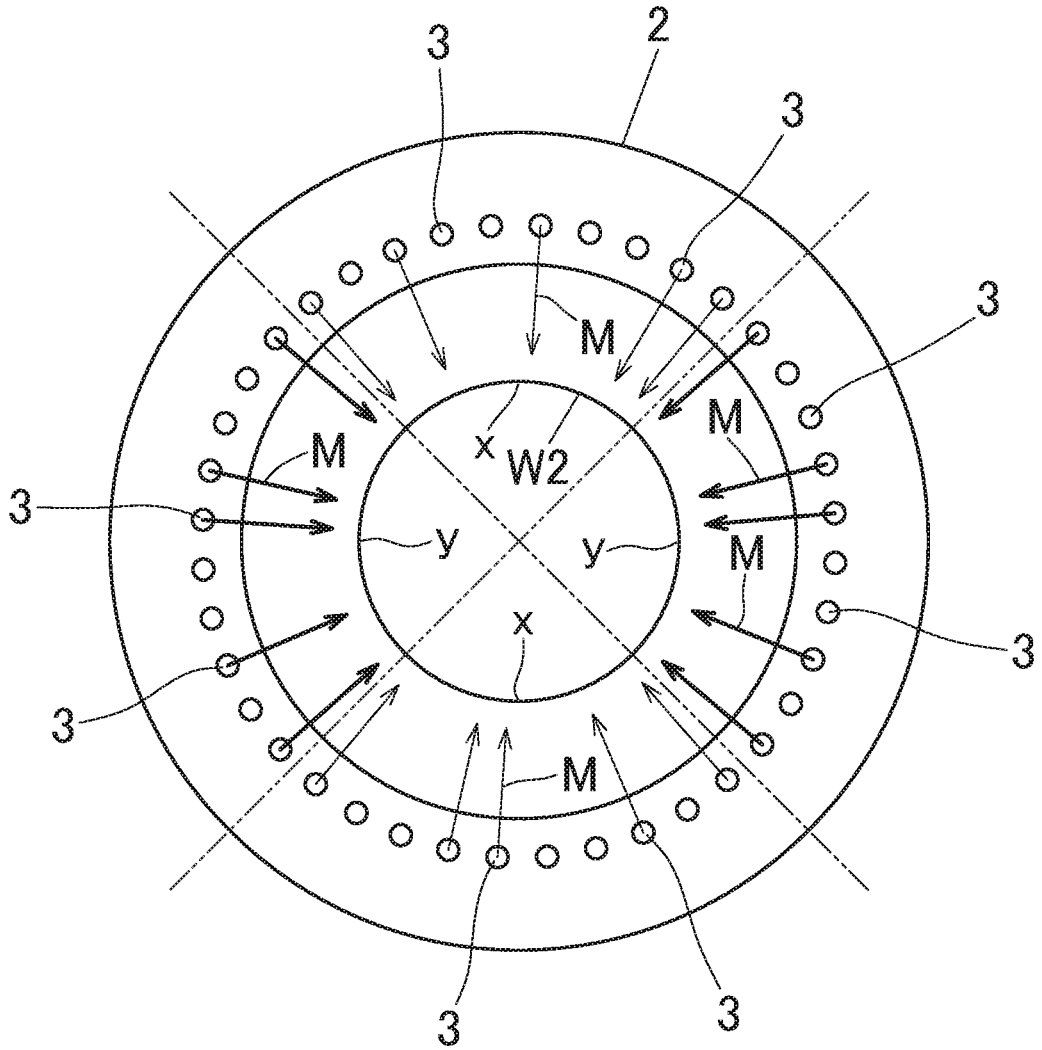
FIG. 5C is a horizontal cross-sectional view schematically showing a third example of a hot-top casting apparatus according to an embodiment.

The mold 2 is cooled by cooling water M as primary cooling water supplied therein. The spouting ports 3 provided on the lower end portion of the mold 2 are configured to eject the cooling water (cooling liquid) M in the mold 2 as secondary cooling water. As shown in FIG. 5A to FIG. 5C, etc., in this embodiment, a plurality of spouting ports 3 is provided in the circumference direction at arbitrary intervals, and the specific configuration of this spouting port 31 will be described later.

In this casting apparatus, an aluminum molten metal W1 as a metal fed in each molten metal receiving tank 4 in each casting machine 1 is supplied into each cooled mold 2. The molten metal W1 supplied into each mold 2 is primarily cooled by coming into contact with each mold 2 to form an ingot W2 in a semi-solidified state. The ingot W2 in the semi-solidified state is in a state in which a coagulation film is formed on its outer peripheral portion.

Each ingot W2 in this state continuously passes downward inside the mold 2, and cooling water M is ejected from each spouting port 31 to the ingot W2 immediately after passing through each mold 2, so that the cooling water M comes into direct contact with the outer peripheral surface of each ingot W2 to cool each ingot W2. In this manner, the ingot W2 is secondarily cooled while being extracted downward, so that the large part thereof is solidified. Thus, three pieces of round bar-shaped continuously cast materials (billets) are simultaneously produced in a state in which they are arranged in parallel.

Figure 3:
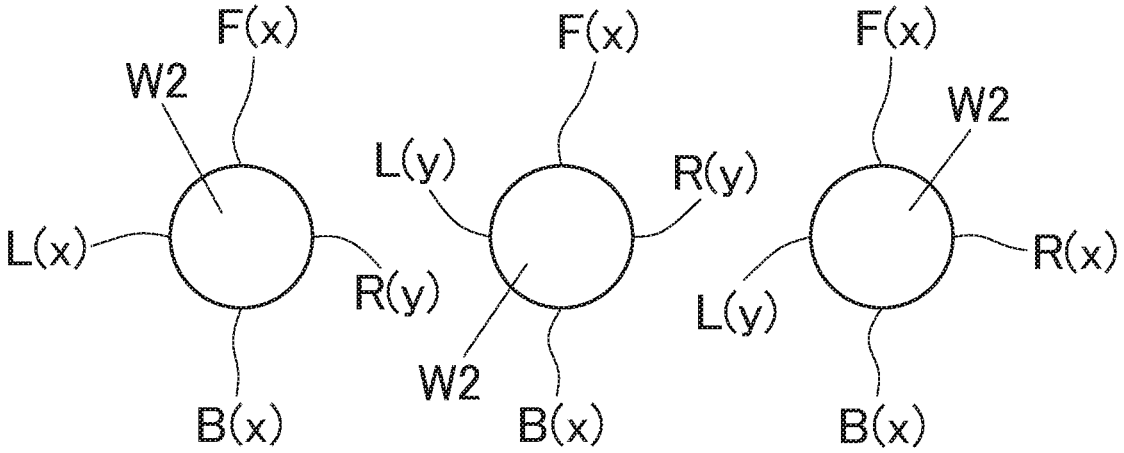
FIG. 3 is a schematic horizontal cross-sectional view for explaining ingots cast by a continuous casting apparatus according to an embodiment.
Figure 4:
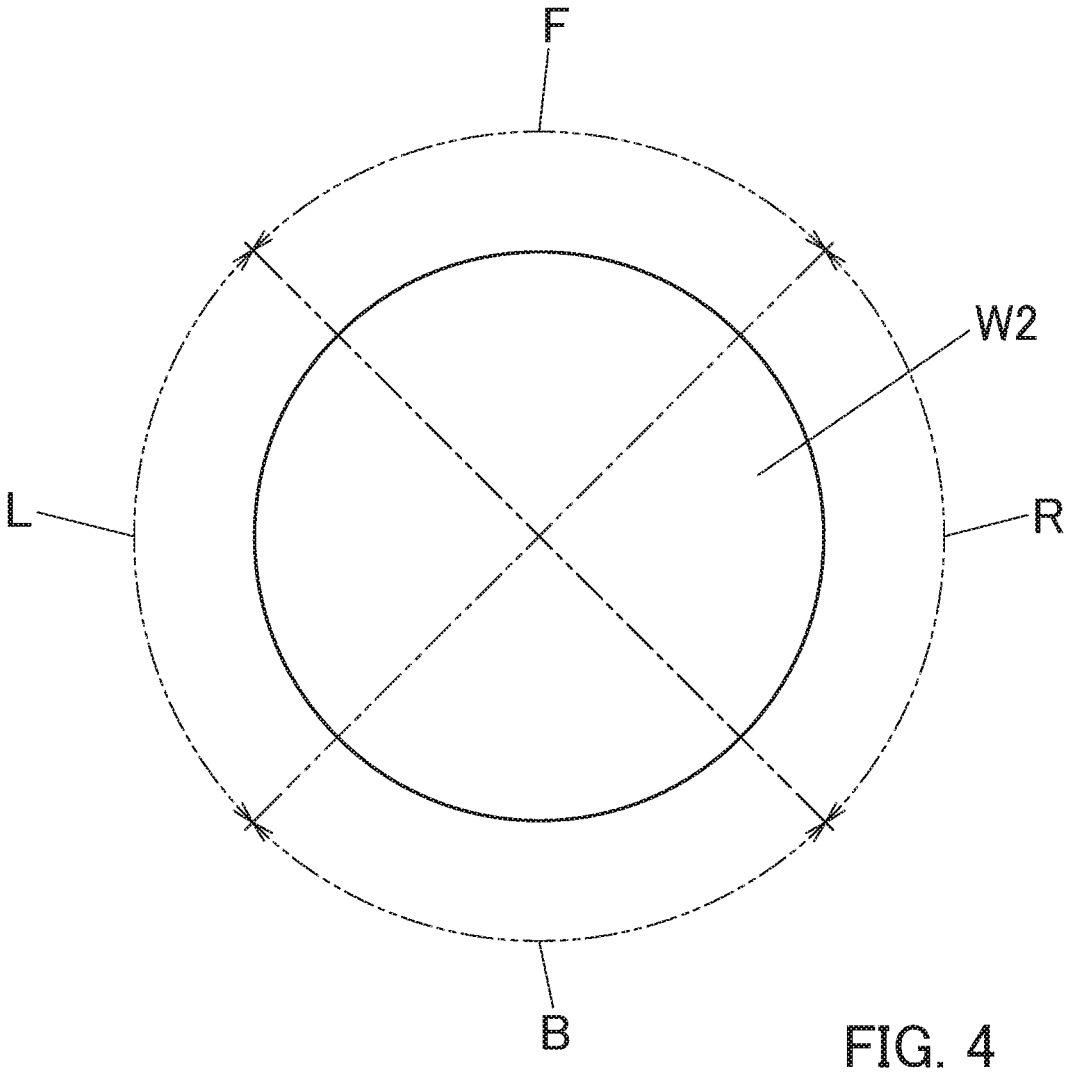
FIG. 4 is a schematic horizontal cross-sectional view for explaining an outer peripheral surface region of an ingot cast by the continuous casting apparatus according to an embodiment.

Next, a method of cooling the ingot W2 in the casting apparatus of this embodiment will be described. FIG. 3 is a schematic horizontal cross-sectional diagram for explaining the ingot (continuously cast rod) W2 cast by the casting apparatus of this embodiment. FIG. 4 is a schematic horizontal cross-sectional diagram for explaining the region of the outer peripheral surface of each ingot W2.

As shown in both diagrams, in this embodiment, three pieces of ingots W2 are cast in parallel in a parallel arrangement, and the outer peripheral surface of each ingot W2 to be cast is divided into four regions in the circumferential direction.

That is, the outer peripheral surface of the ingot W2 is divided into four equal regions in the circumferential direction. Among the divided regions, the region of the front side (the upper region in FIG. 3 and FIG. 4) is defined as a front side region F, the region of the back side (the lower region in FIG. 3 and FIG. 4) is defined as a back side region B, the region of the right side (the right side region in FIG. 3 and FIG. 4) is defined as a right side region R, and the region of the left side (the left side region in both figures) is defined as a left side region L. Further, of the four regions, the region closed by another ingot W2 by facing the another adjacent ingot W2 is defined as an "ingot facing region y", and the region not facing another adjacent ingot W2, i.e., the region where another ingot W2 is not present and is open, is defined as an "open region x". For example, in the ingot W2 positioned at the left end of FIG. 3, the front side region F, the back side region B, and the left side region L are defined as open regions x, and the right side region R is defined as an ingot facing region y. Further, in the ingot W2 positioned in the middle of FIG. 3, the front side region F and the back side region B are defined as open regions x, and the left side region L and the right side region R are defined as ingot facing regions y. Further, in the ingot W2 positioned at the right end of FIG. 3, the front side region F, the back side region B, and the right side region R are defined as open regions x, and the left side region L is defined as an ingot facing region y.

In this embodiment, when cooling the ingot W2 by ejecting cooling water M, the degree of cooling to the open region x is set to be less than the degree of cooling to the ingot facing region y so that the open region x is cooled with weak cooling and the ingot facing region y is cooled with strong cooling.

Here, in this embodiment, it should be noted that reducing the degree of cooling means that the amount of heat absorbed from the ingot W2 is reduced, and on the contrary, increasing the cooling degree means that the amount of heat absorbed from the ingot W2 is increased. Also note that, in the present invention, the open region x denotes a region not facing another ingot W2, and is not required to be completely open. For example, in the present invention, even if the open region x is closed by a member other than an ingot, such as, e.g., a housing wall, it can be regarded as an open region as long as it does not face another ingot W2.

Next, a specific example of a method of cooling an ingot W2 in this embodiment will be described. As shown in FIG. 5A, in the mold 2 of each casting machine 1 in the casting apparatus of this embodiment, a cooling water spouting port 3 is formed corresponding to the outer peripheral surface of the ingot W2 to be cast. A plurality of the spouting ports 3 is arranged in the circumferential direction at equal intervals. In the casting machine 1 shown in FIG. 5A, in the spouting port 3 arranged corresponding to the open region x on the outer peripheral surface of the ingot W2 to be cast, the hole diameter (caliber) is formed to be smaller than that of the spouting port 3 arranged corresponding to the ingot facing region y. As a result, cooling water M is ejected to the open region x from the spouting port 3 having a small caliber, and cooling water M is ejected to the ingot facing region y from the spouting port 3 having a large caliber. Thus, the supply quantity of the cooling water M to the open region x becomes less than that of the ingot facing region y, so that the open region x is cooled with weak cooling and the ingot facing region y is cooled with strong cooling.

Further, in the casting machine 1 shown in FIG. 5B, although the respective calibers of the plurality of spouting port 3 are configured to be the same in size (hole diameter), the interval (pitch) between the adjacent spouting ports 3 of the plurality of spouting ports 3 arranged in the open region x is set to be wider than the interval (pitch) between the adjacent spouting ports 3 of the plurality of spouting ports 3 arranged in the ingot facing region y. As a result, cooling water M is ejected to the open region x from the spouting port 3 in which the pitch is wide and spacely arranged, cooling water M is ejected to the ingot facing region y from the spouting port 3 in which the pitch is narrow and densely arranged. Thus, the supply quantity of the cooling water M in the open region x becomes less than that in the ingot facing region y, and the open region x is cooled with weak cooling, and the ingot facing region y is cooled with strong cooling.

As described above, by setting the total open area of the spouting ports 3 corresponding to the open region x to be smaller than the total open area of the spouting ports 3 corresponding to the ingot facing region y, the open region x can be cooled with weak cooling as compared with the ingot facing region y. Note that in this embodiment, a supply quantity adjustment means is composed of a plurality of spouting ports 3 different in caliber and pitch.

In the above-mentioned embodiment, the shape of the spouting port 3 is formed in a circular shape, but the shape of the spouting port 3 is not particularly limited. In the present invention, an oval shape, an elliptical shape, a slit shape, a polygonal shape such as a triangle and a quadrangle, a different shape, a mixture of these shapes or the like can be employed. Further, even when a spouting port 3 having a shape other than a circular shape is employed, the degree of cooling can be adjusted by adjusting the caliber and/or the pitch in the same manner as described above.

Specifically, when a slit-like spouting port 3 is adopted, the slit width is changed stepwise or continuously so that the slit width is 1 mm in the spouting port 3 for weak cooling and the slit width is 2 mm in the spouting port 3 for strong cooling. When a circular spouting port 3 is adopted, the hole diameter is changed stepwise or continuously so that the hole diameter is φ2 mm in the spouting port 3 for weak cooling and the hole diameter is φ3 mm in the spouting port 3 for strong cooling, or the pitch is changed stepwise or continuously so that the interval (pitch) between adjacent spouting ports is 15 degrees in the portion for weak cooling and the pitch is 10 degrees in the portion for strong cooling.

In this embodiment, the open region x can also be cooled with weak cooling by adjusting the supply pressure (water pressure) of the cooling water M from the spouting port 3. For example, as shown in FIG. 5C, in the mold 2 of the casting machine 1, a plurality of spouting ports 3 having the same caliber is formed in equal intervals in the circumferential direction. The water pressure of the cooling water M ejected from the spouting port 3 arranged corresponding to the open region x is set to be lower than the water pressure of the cooling water M ejected from the spouting port 3 arranged corresponding to the ingot facing region y. As a result, the cooling water M is supplied to the open region x at a low pressure and at a low speed, the cooling water M is supplied to the ingot facing region y at a high pressure and at a high speed. Thus, the supply quantity of the cooling water M to the open region x becomes smaller than that to the ingot facing region y, so that the open region x is cooled with weak cooling and the ingot facing region y is cooled with strong cooling.

Here, in the cooling method of FIG. 5C, the supply quantity adjustment means is constituted by a water pressure adjustment means (supply pressure adjustment means) such as a water flow pump for adjusting the water pressure of the cooling water M.

In the present invention, a water pressure adjustment means capable of adjusting the water pressure of the cooling water M may be provided for each spouting port 3. In this case, the water pressure of the cooling water M can be finely adjusted for each spouting port 3, so that the cooling degree can be more finely adjusted, which in turn makes it possible to cast a higher-quality continuously cast material. However, if a water pressure adjustment means is provided for each spouting port 3, the number of installed water pressure adjustment means increases. For this reason, there is a risk that the structure may become complicated and the cost may increase.

In the examples of FIG. 5A to FIG. 5C, the hole diameter, the hole pitch, the water pressure, etc., may be continuously changed so that the amount of cooling water M gradually increases from the circumferential intermediate position of the open region x to the circumferential intermediate position of the ingot facing region y. Alternatively, a constant small amount of water may be supplied to the entire area of the open region x and a constant large amount of water may be supplied to the entire area of the ingot facing region y so that the amount of water varies stepwise between the open region x and the ingot facing region y.

Note that, in this embodiment, the degree of cooling is adjusted by adjusting the caliber and the pitch of the spouting port 3 or by adjusting the water pressure of the cooling water M from the spouting port 3, but the present invention is not limited to this. In the present invention, the degree of cooling can be adjusted by changing the temperature of the cooling water or the type of the cooling water (cooling liquid). For example, by setting the temperature of the cooling water M sprayed to the open region x to be higher than the temperature of the cooling water M sprayed to the ingot facing region y, the open region x can be cooled with weak cooling. Further, as the cooling liquid to be sprayed to the ingot facing region y, by adopting a cooling liquid having a higher cooling capacity than the cooling liquid to be sprayed to the open region x, the open region x can be cooled with a weak cooling weaker than the ingot facing region y.

As described above, according to this embodiment, in the continuous casting apparatus in which a plurality of ingots (continuously cast material) W2 is cast in parallel, the open region x of the outer peripheral surface of a predetermined ingot W2 which does not face another ingot W2 is cooled with weak cooling with respect to the ingot facing region y facing another ingot W2. Therefore, all of the ingots W2 can be cast with high quality.

That is, of the outer peripheral surface of the ingot W2, the open region x is hardly affected by heat from another ingot W2, and therefore the cooling efficiency is high, whereas the ingot facing region y is easily affected by heat from another adjacent ingot W2, and therefore the cooling efficiency is low. Therefore, in this embodiment, since the open region x having a high cooling efficiency is cooled with weak cooling as compared with the ingot facing region y having a low cooling efficiency, the respective ingots W2 can be cooled in a well-balanced manner from the entire circumference to the center portion. Thus, the entire ingot can be formed into a uniform and good ingot structure. For this reason, a high-quality ingot (continuously cast material) W2 with no variation can be assuredly cast.

Besides, in this embodiment, by cooling the open region x with weak cooling, excessive cooling can be prevented, so that the energy required for cooling can be prevented from being wasted unnecessarily. As a result, cooling can be more efficiently performed, which in turn can improve the productivity of a cast product.

In the aforementioned embodiment, a case in which the present invention is applied to three ingots W2 arranged in one row is exemplified, but the present invention is not limited to this. The present invention can also be applied to a plurality of ingots arranged in two or more rows and two or more columns in the same manner as described above.

Figure 6:
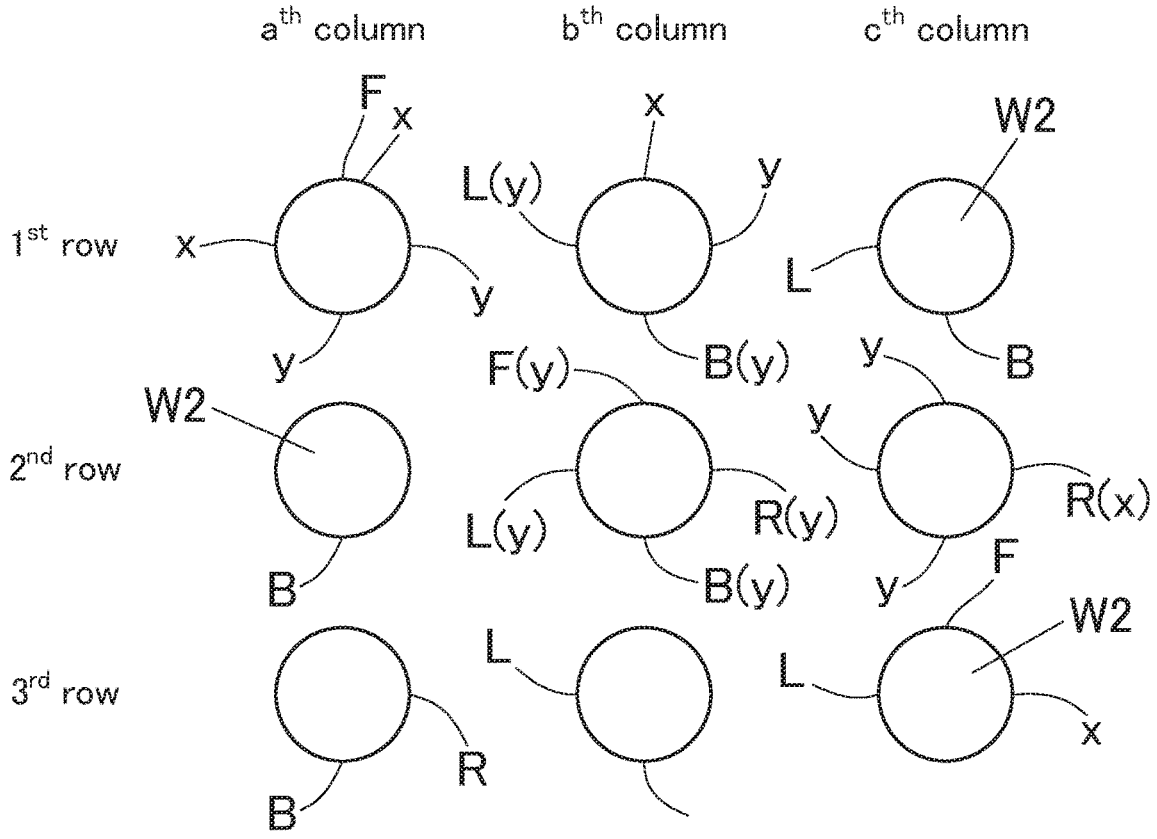
FIG. 6 is a schematic horizontal cross-sectional diagram for explaining a cooling method of ingots in a continuous casting apparatus according to another embodiment of the present invention.

For example, as shown in FIG. 6, in a continuous casting apparatus according to another embodiment of the present invention, a total of nine pieces of ingots W2 arranged in three rows and three columns are simultaneously cast in parallel. In this embodiment, to facilitate understanding of the present invention, in FIG. 6 the first row from the top will be defined as a $1^{st}$ row, the second row from the top will be defined as a $2^{nd}$ row, and the third (lowest) row from the top will be defined as a $3^{rd}$ row. Further, the leftmost column will be defined as an $a^{th}$ column, the second column from the left will be defined as a $b^{th}$ column, and the rightmost column will be defined as a $c^{th}$ column.

In this another embodiment of FIG. 6, in the ingot W2 arranged in the $1^{st}$ row and $a^{th}$ column (upper left), the front side region F and the left side region L of the outer peripheral side are defined as the open regions x, and the back side region B and the right side region R are defined as ingot facing regions y. Further, in the ingot W2 arranged in the first row and $b^{th}$ column, only the front side region F is defined as the open region x, and the back side region B and both side regions L and R are defined as ingot facing regions y. In the ingot W2 arranged in the $2^{nd}$ row and $b^{th}$ column (center), all of the regions F, B, L, and R of all of the front, back, left, and right peripheries are defined as the ingot facing regions y. In this ingot W2 of the $2^{nd}$ row and $b^{th}$ column, the entire circumference is cooled with the same degree, that is, with strong cooling, without adjusting the degree of cooling. Therefore, in the present invention, for the ingot W2 arranged in three or more rows and three or more columns, in the ingot W2 arranged in the outer periphery with the exception of the ingot W2 in the center thereof, the open region x is cooled with weak cooling as compared with the ingot facing region y. In other words, the present invention is not applied to the centrally arranged ingot W2 in which an open region x is not present, and the present invention is applied to the ingot W2 in which an open region x is present and is arranged on the outer side. That is, the present invention is applied to an ingot W2 in which an open region x exists, in particular, to an ingot W2 in which at least one or more open regions x exist. In the present invention, ingots W2 other than the ingot in which the entire periphery is surrounded by ingots, for example, the ingot W2 arranged in the $1^{st}$ row or $2^{nd}$ column, are all ingots W2 arranged on the outer side.

Figure 7:
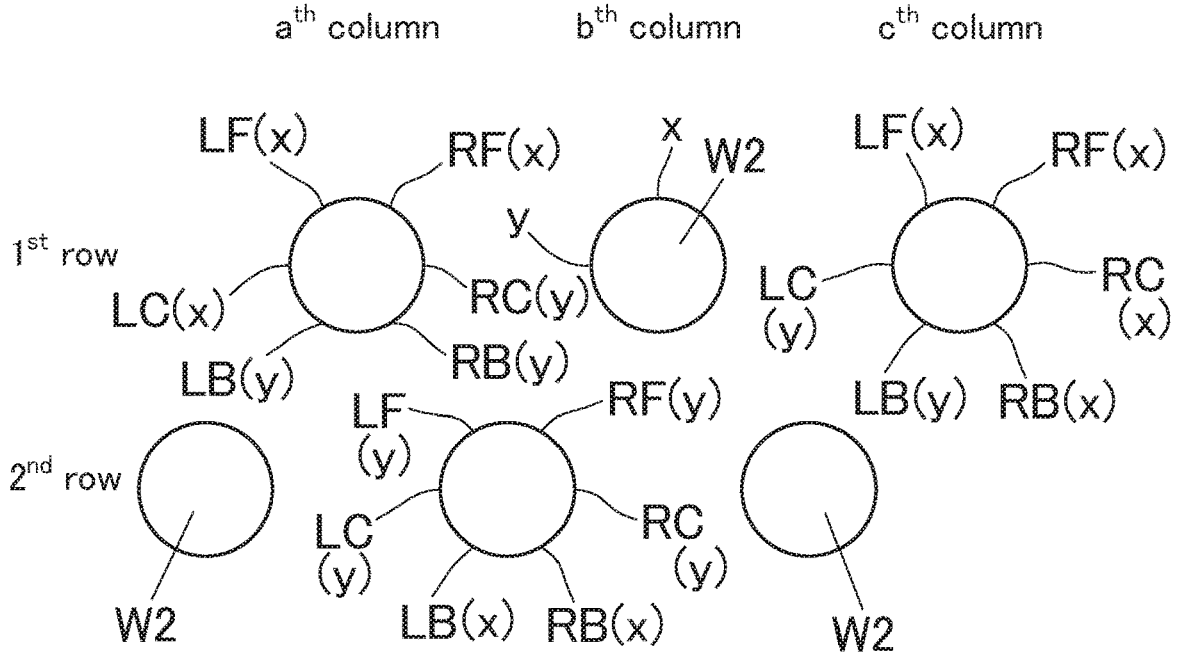
FIG. 7 is a schematic horizontal cross-sectional view for explaining a cooling method of ingots in a continuous casting apparatus according to another embodiment of the present invention.

FIG. 7 is a schematic horizontal cross-sectional diagram for explaining the cooling method of ingots in the continuous casting apparatus, which is another embodiment of the present invention. In this embodiment, ingots W2 are cast simultaneously in parallel in a state in which ingots are arranged in two rows from front to back and three columns from left to right (a to c columns). In the ingot W2 arrangement form, in the aforementioned another embodiment or the like as shown in the aforementioned FIG. 6, the present invention is applied to the ingots W2 of the so-called square arrangement in which the axes of the four adjacent ingots W2 are located at the four vertices of the square in a plan view. On the other hand, the embodiment shown in FIG. 7 is a case in which the present invention is applied to the embodiment of the so-called regular triangle arrangement in which the axes of the three adjacent ingots W2 are located at the three vertices of the regular triangle in a plan view.

Figure 8:
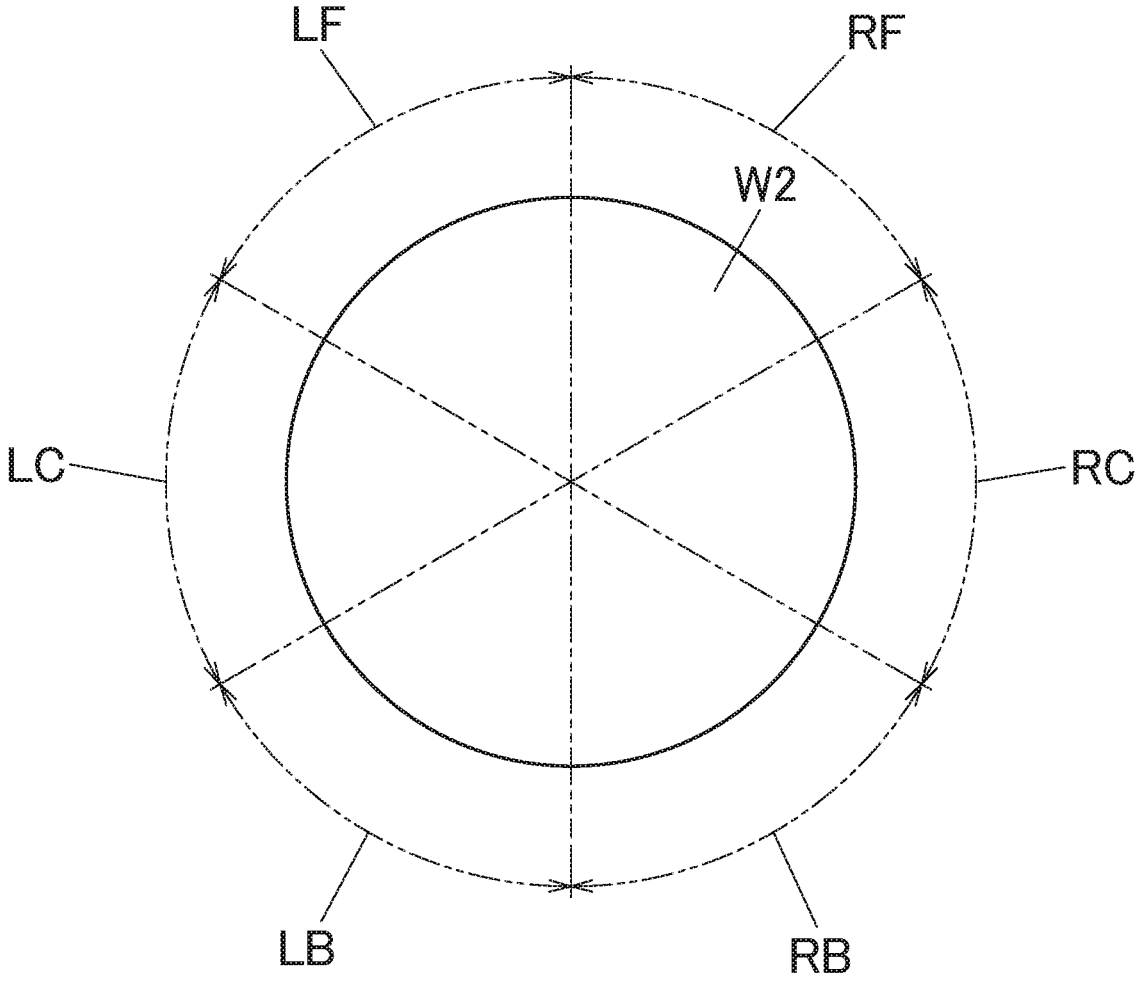
FIG. 8 is a schematic horizontal cross-sectional diagram for explaining an outer peripheral surface region of an ingot in a continuous casting apparatus according to another aforementioned embodiment.

In the embodiment of FIG. 7, as shown in FIG. 8, the outer peripheral surface of each ingot W2 is divided into six equal regions. Of the divided regions, the intermediate region on the left side is defined as a left center region LC, the front region on the left side is defined as a left front region LF, the back region on the left side is defined as a left back region LB, the center region on the right side is defined as a right center region RC, the front side region on the right side is defined as a right front region RF, and the back region on the right side is a right back region RB.

For example, in the ingot W2 arranged in the $1^{st}$ row and $a^{th}$ column (upper left in FIG. 7), the left center region LC, the left front region LF, the right front region RF are defined as open regions x, and the right center region RC, the right back region RB, and the left back region LB are defined as ingot facing regions y. Therefore, the open regions x are cooled with weak cooling as compared with the ingot facing regions y.

In the ingot W2 arranged in the $1^{st}$ row and $c^{th}$ column (upper right in FIG. 7), the left front region LF, the right front region RF, the right center region RC, and the right back region RB are defined as open regions x, and the left center region LC, and the left back region LB are defined as ingot facing regions y. Therefore, the open regions x is cooled with weak cooling as compared with the ingot facing regions y.

Further, in the ingot W2 arranged in the $2^{nd}$ row and the $b^{th}$ column, the left back region LB, and the right back region RB are defined as open regions x, and the left center region LC, the left front region LF, the right front region RF, and the right center region RC are defined as ingot facing regions y. Therefore, the open regions x are cooled with weak cooling.

As described above, for ingots W2 which are cast in an equilateral triangular arrangement, the outer peripheral surface thereof may be divided into six equal regions in the circumferential direction, and either the open region x or the ingot facing region y may be set for each region LC, LF, LB, RC, RF, and RB divided into six equal regions.

In the aforementioned embodiments, the present invention is applied to a vertical-type continuous casting apparatus in which the casting direction is set in a vertical direction as an example, but the present invention is not limited to this, and can also be applied to, for example, a horizontal-type continuous casting apparatus in which the casting direction is set in a direction other than a vertical direction.

INDUSTRIAL APPLICABILITY

The production apparatus of a continuously cast metal rod of the present invention can be suitably used for producing a continuously cast material used as a material for an extrusion material, a rolled material, a forged material, etc., made of metal such as aluminum.

The present application claims priority to Japanese Patent Application No. 2019-36612 filed on Feb. 28, 2019, the entire disclosure of which is incorporated herein by reference in its entirety.

It should be understood that the terms and expressions used herein are used for explanations and have no intention to be used to construe in a limited manner, do not eliminate any equivalents of features shown and mentioned herein, and allow various modifications falling within the scope of the present invention.

DESCRIPTION OF SYMBOLS

1: casting machine
2: mold
3: spouting port
X: open region
Y: ingot facing region
M: cooling water (cooling liquid)
W2: ingot (continuously cast material)

The invention claimed is:

1. A method of producing a continuously cast metal rod in which a cooling liquid is supplied to each of outer peripheral surfaces of a plurality of ingots extracted from a plurality of molds in parallel to cool each of the plurality of ingots, wherein when a region of the outer peripheral surface of each ingot which is open and does not face another ingot is defined as an open region, and a region of the outer peripheral surface of the each ingot which faces another ingot is defined as an ingot facing region, the open region is cooled with weak cooling in which a degree of cooling by the cooling liquid at the open region is less than a degree of cooling by the cooling liquid at the ingot facing region.

2. The method of producing a continuously cast metal rod as recited in claim 1, wherein a supply quantity of the cooling liquid to the open region is set to be less than a supply quantity of the cooling liquid to the ingot facing region.

3. The method of producing a continuously cast metal rod as recited in claim 1, wherein supply pressure of the cooling liquid to the open region is set to be lower than supply pressure of the cooling liquid to the ingot facing region.

* * * * *